United States Patent [19]

Faye

[11] 4,309,792

[45] Jan. 12, 1982

[54] HINGED BRACKET ASSEMBLY FOR A DRAIN TROUGH

[76] Inventor: Lloyd H. Faye, 8821 Elm Rd., Richmond, Va. 23235

[21] Appl. No.: 148,082

[22] Filed: May 12, 1980

[51] Int. Cl.[3] ..... E05D 5/06; E04D 13/06

[52] U.S. Cl. ..... 16/389; 52/11; 16/385

[58] Field of Search ..... 16/135, 137, 128 R; 52/11, 14–16; 248/48.1

[56] References Cited

U.S. PATENT DOCUMENTS 4,014,074 3/1977 Faye ..... 16/135

4,116,008 9/1978 Ward ..... 52/11 X 4,117,635 10/1978 Nelson ..... 52/11

*Primary Examiner*—Werner H. Schroeder

*Assistant Examiner*—Andrew M. Falik

*Attorney, Agent, or Firm*—Norman B. Rainer

[57] ABSTRACT

A hinged bracket assembly is provided for use in mounting a drain trough beneath the eaves of a building and enabling the trough to be inverted to facilitate the cleaning and servicing thereof. The assembly is of sturdy construction comprised of two major components, each of which can be economically fabricated by cutting operations applied to an extruded structure.

4 Claims, 4 Drawing Figures

HINGED BRACKET ASSEMBLY FOR A DRAIN TROUGH

BACKGROUND OF THE INVENTION

This invention relates to an improvement in a drain trough system generally associated with the eaves of a roof of a building, and is more particularly concerned with a device which facilitates the mounting and maintenance of drain troughs.

Most residential-type houses or dwellings are constructed with pitched roofs, the sloped nature of which prevents the accumulation of water thereon. Beneath the lower extremity of a pitched roof, generally referred to as the eaves, there is positioned a drain trough or gutter, the purpose of which is to catch water which runs off the roof, and channel it to a downspout which leads the water away from the foundation of the house.

In the course of time, such drain troughs tend to accumulate debris such as fallen leaves, which obstructs the trough, thereby rendering it ineffective for its intended purpose. Also, in the course of time, the trough, usually of metal construction, may require maintenance such as scraping and/or painting. The servicing of such troughs for the purposes of cleaning or painting generally requires the use of a ladder, which makes the task difficult and often perilous.

Although a number of methods have been previously disclosed for simplifying the servicing of eaves-mounted drain troughs, none have been completely successful in operation or sufficiently practical to enjoy widespread commercial utilization. Mechanically modified drain troughs have been proposed, such as the one disclosed in U.S. Pat. No. 538,108, issued Apr. 23, 1895, which enable the trough to be manually tilted or inverted so that its contents will dump out. However, the specific features of such systems generally require use of costly non-standard, specifically constructed drain troughs. Also, their installation onto the eaves of a house may be so difficult as to render them impractical. This is particularly the case with modern houses wherein the roof overhangs by not more than about two inches the upper peripheral wooden trim panels of the underlying walls, said panels being generally referred to as the fascia.

The use of hinged brakcets to mount a standard drain trough to the fascia in a manner permitting inversion of said trough to discharge its contents has been disclosed in U.S. Pat. No. 4,014,074.

It is an object of the present invention to provide an improved hinged bracket for use in mounting a conventional drain trough to the fascia of a building.

It is another object of this invention to provide a bracket of the aforesaid nature adapted to permit said trough to be inverted so as to discharge its contents.

It is a further object to provide a bracket of the aforesaid nature which, in comparison with prior devices, is of more sturdy construction, and less costly to fabricate.

These objects and other objects and advantages of the invention will be apparent from the following description.

SUMMARY OF THE INVENTION

The above and other beneficial objects and advantages are accomplished in accordance with the present invention by an improved hinged bracket assembly comprising an upper harness member pivotably joined to a lower support bracket member.

The harness member is constructed so as to enclasp a conventional drain trough in a slideably adjustable manner. The contour of the harness member is such as to permit the drain trough, when seated within the harness member, to fit closely against the fascia of a building, as in the usual manner of installing a conventional drain trough on houses of current design. The harness member is of integral monolithic construction specifically contoured in a manner permitting its fabrication by cutting and milling operations applied to a substantially continuous extruded structure. Said extruded structure may be characterized as having a cross-sectional configuration which is constant along its long axis.

The harness member has a generally L-shaped cross sectional configuration comprised of a rear panel, and a bottom panel perpendicularly disposed with respect to said rear panel. An elongated rod of circular cross section extends forwardly of the front edge of said bottom panel and is connected thereto by an extension plate, said rod serving as the rotatable internal member of a hinge assembly.

The support bracket member is also of integral monolithic construction specifically contoured in a manner permitting its fabrication by the removal of selected portions from a continuous extruded structure. The bracket member has a generally L-shaped cross sectional configuration comprised of a rear panel and bottom panel, said panels having substantially the same widths as the corresponding panels of the harness member. Associated with the front edge of the bottom panel of said bracket member is a pair of spaced apart coaxially aligned tubular bushings, at least one of which is provided with a slot parallel to the axis of said bushings.

The hinged bracket assembly is assembled by slideably causing the elongated rod of said harness member to enter said bushings while said extension plate passes through the axially aligned slot of the bushings. After said rod is entered within said bushings, sleeve bearings are preferably fitted onto said rod and anchored within said bushings to prevent subsequent passage of said extension plate through said slot. The hinged bracket assembly is attached to the fascia by fastening means acting in associated with the rear panel of said support bracket member.

BRIEF DESCRIPTION OF THE DRAWINGS

For a fuller understanding of the nature and objects of the invention, reference should be had to the following detailed description taken in connection with the accompanying drawings forming a part of this specification and in which similar numerals of reference indicate corresponding parts in all the figures of the drawing.

DESCRIPTION OF THE PREFERRED EMBODIMENTS

Figure 1:
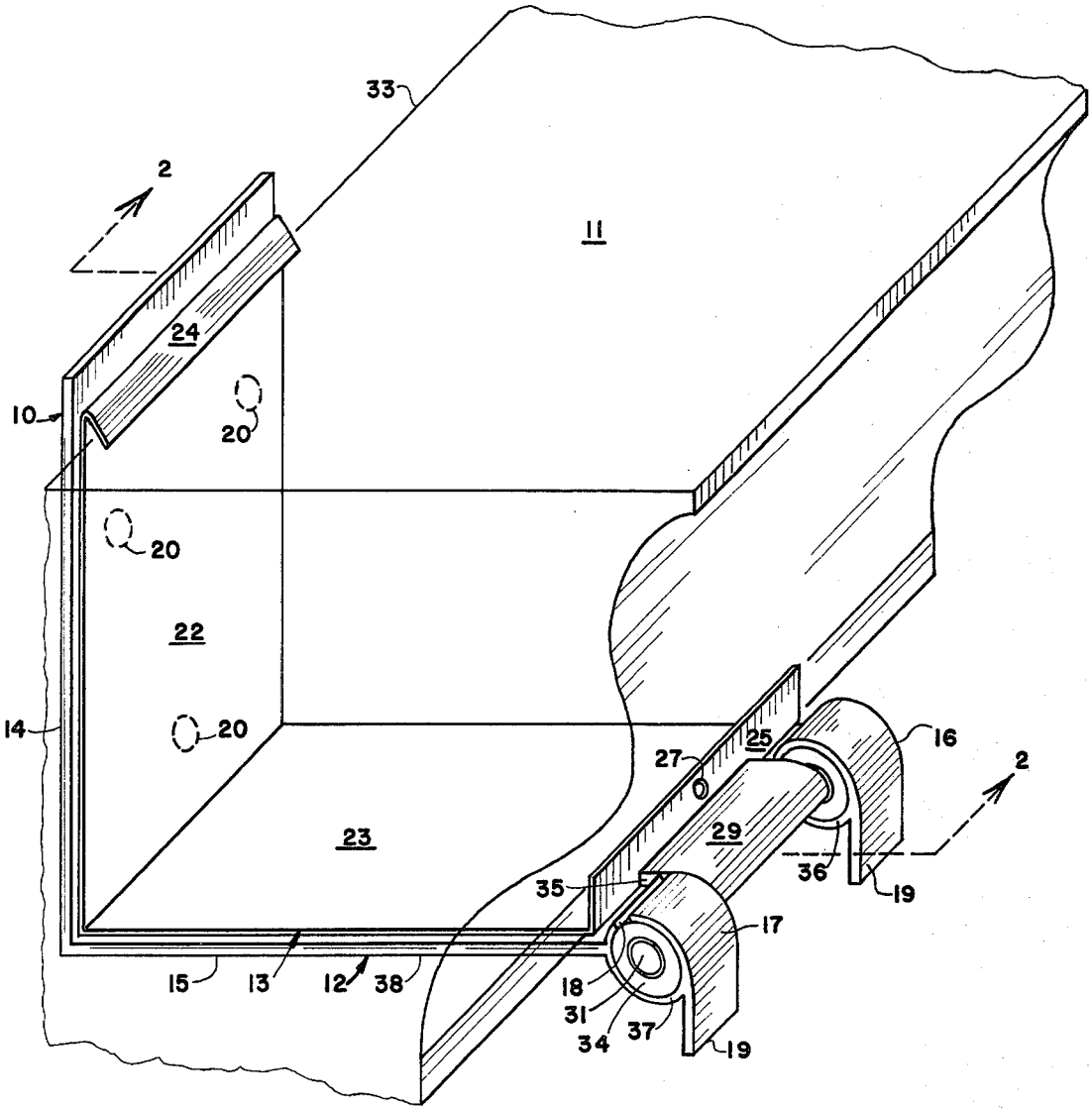
FIG. 1 is a perspective view of an embodiment of hinged bracket assembly of the present invention showing a portion of a drain trough positioned in upright mode within said assembly.

Referring to FIG. 1, a hinged bracket assembly 10 of the present invention is shown holding a conventional drain trough 11, not a part of this invention, said trough being positioned in its upright, functional position adapted to catch water falling from the edge of an overhead roof, not shown. The hinged bracket assembly is comprised of a support bracket 12 hingedly engaged with a harness 13. Support bracket 12, having a generally L-shaped configuration, is comprised of vertical rear panel 14, and horizontal bottom panel 15 perpendicularly joined to rear panel 14 at the lowermost extremity thereof, said panels extending lengthwise between parallel side edges 38. The forward edge of said bottom panel has attached thereto a pair of spaced apart coaxially disposed circular cylindrical bushings 16 and 17, having facing extremities 36 and outer extremities 37 lying in planes perpendicular to said forward edge. At least one of said bushings has a slot 18 positioned at an elevation above bottom panel 15 and aligned coextensively with the axis of said bushings. Abutment tabs 19 extend downwardly from sites on the exterior of said bushings disposed generally below bottom panel 15 and forward of the axis of said bushings. Holes 20 are symmetrically located in rear panel 14 to facilitate attachment of support bracket 12 to the fascia of a building.

Figure 2:
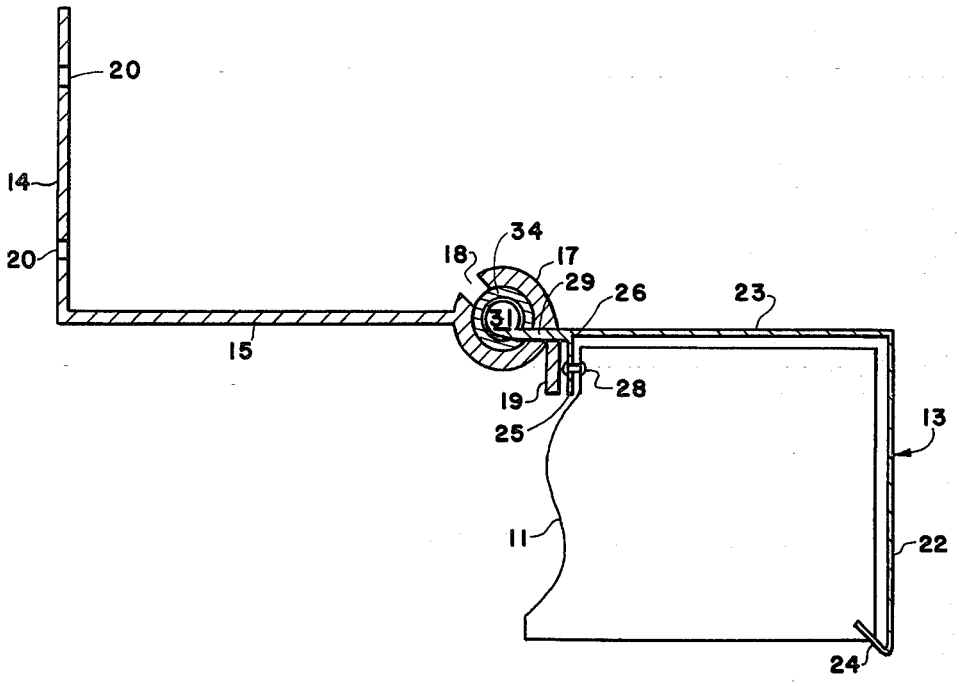
FIG. 2 is a sectional side view of the hinged bracket assembly taken along the line 2—2 of FIG. 1, and showing the drain trough positioned in the inverted mode.
Figure 3:
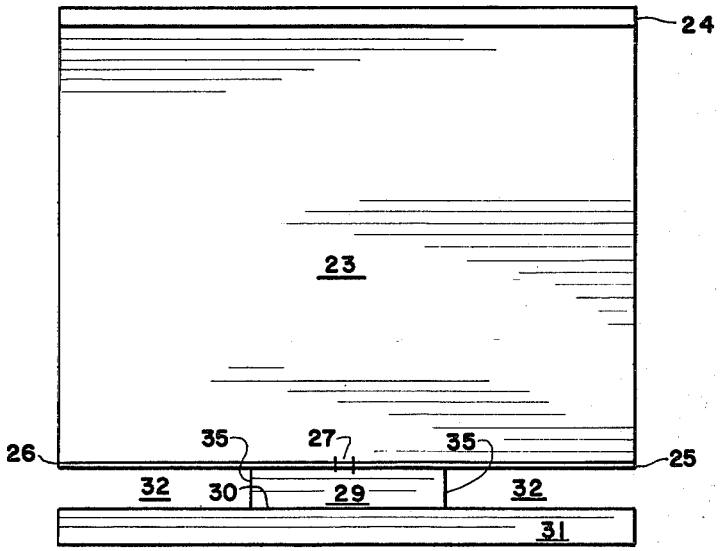
FIG. 3 is a top view of the harness member of the hinged bracket assembly of FIG. 1.
Figure 4:
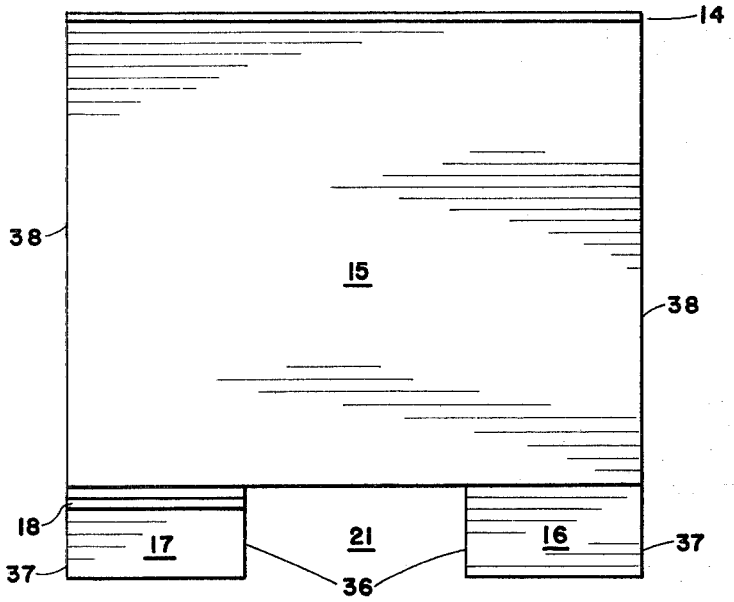
FIG. 4 is a top view of the support bracket member of the hinged bracket assembly of FIG. 1.

The support bracket 12 illustrated in FIGS. 1, 2 and 4 is of integral monolithic construction and may be fabricated from a continuous extruded structure by cutting said extruded structure transversely at sites corresponding to the desired length of said bracket, and then removing material from the regions 21 and 18 shown in FIG. 4.

Harness 13 is comprised of rear panel 22, and bottom panel 23 which is perpendicularly joined to rear panel 22 at the lowermost extremity thereof. The upper extremity of rear panel 22 is provided with a retaining lip 24 which extends downwardly in the direction of bottom panel 23. Said lip 24 traverses the entire length of rear panel 22 and extends downwardly a distance of between about ¼ inch and ½ inch. An attachment strip 25 extends perpendicularly upward from the forwardmost edge 26 of bottom panel 23 and traverses the entire length of bottom panel 23. The height of attachment strip 25 is between about ¼ inch and ¾ inch. A hole 27 may be provided in strip 25 to facilitate attachment of said strip to drain trough 11 by rivets 28 or equivalent fastening means. An extension plate 29 protrudes forwardly a distance of between about 174 inch to one inch from the forwardmost edge 26 of bottom panel 23. The forwardmost edge 30 of plate 29 supports an elongated rod 31 of circular cross-section, the axis of which is disposed parallel to the forwardmost edge 26 of bottom panel 23. The length of plate 29, measured between side edges 35 is substantially equal to the spacing between facing extremities 36 of said bushings. The length of rod 31 corresponds to the length of bottom panel 23. The diameter of rod 31 is such as to make a close fit within cylindrical sleeve bearings 34 confined by bushings 16 and 17. Elongated spaces 32 exist between rod 31 and the forwardmost edge 26 of bottom panel 23 on each side of plate 29, the width of said spaces being at least as great as the radially measured wall thickness of bushings 16 and 17.

The harness 13 and support bracket 12 of the hinged bracket assembly of this invention are preferably fabricated from continuous extruded shapes comprised of metals such as aluminum, magnesium and alloys thereof, or thermoplastic resins such as polypropylene, polyvinylchloride, styrene-acrylonitrile-butadiene copolymers, and equivalents thereof. The thickness of the several flat portions such as rear and bottom panels, retaining lip and attachment strip may range from about 1 to 3 millimeters. The diameter of rod 31 may range from about 3 to 15 millimeters.

In assembling the hinged bracket assembly of the present invention, rod 31 of harness 13 is entered into bushing 17 having slot 18. Plate 29 is caused to pass through slot 18. The entering movement of harness 13 is continued until plate 29 resides in the space 21 between the bushings. In this position the harness can be pivotably moved 180° about the axis of rod 31, and the edges 35 of plate 29 are in sliding abutment with the facing inside edges 36 of said bushings. Sleeve bearings, which may be fabricated of metal, plastic or other suitable materials of low frictional characteristics are placed on rod 31 and immoveably anchored within said bushings by means of adhesive or other fastening techniques. The primary purpose of the anchored bearings is to prevent subsequent passage of the extension plate through the slot.

One extreme of said 180° movement is the seated position shown in FIG. 1 wherein the bottom panels of the bracket and harness are in abutment. The opposite extreme of pivoted movement is shown in FIG. 2, wherein attachment strip 25 is in abutment tabs 19 extending downwardly from bushings 16 and 17. The assembled hinged bracket assembly is attached to the fascia of a building by use of nails, screws or equivalent fastening means acting through rear panel 14 of bracket 12, holes 20 being provided for such purpose. The drain trough is attached to harness 13 by causing the upper rear edge 33 of said drain trough to fit under retaining lip 24, and then fastening the lower front portion of said trough to attachment strip 25. Said fastening may be achieved by a rivet 28 inserted through hole 27 in attachment strip 25, or by other means. In preferred embodiments, rear panel 22 of said harness possesses sufficient flexibility to facilitate engagment with said trough.

In the normal or water collecting mode, the drain trough will be in upright position seated above bracket 12, as shown in FIG. 1. When it is desired to clean or service the drain trough, it is inverted to the position shown in FIG. 2 wherein harness 13 has been rotated 180°, and bottom panel 23 is in substantially horizontal position. The inversion may be achieved by means of a long pole manually applied to the trough or by pulley means or other mechanical means adapted to act upon the trough.

While particular examples of the present invention have been shown and described, it is apparent that changes and modifications may be made therein without departing from the invention in its broadest aspects. The aid of the appended claims, therefore, is to cover all such changes and modifications as fall within the true spirit and scope of the invention.

Having thus described my invention, what is claimed is:

1. A hinged bracket assembly for pivotably attaching a drain trough to the fascia of a building beneath the edge of a roof thereof comprising:

a. a harness member of integral monolithic construction derived from an extruded structure and having a generally L-shaped configuration comprised of a flat rear panel having straight parallel uppermost and lowermost edges, a flat bottom panel emanating from the lowermost edge of said rear panel, extending perpendicularly from said rear panel and terminating in a front edge, the lengths of said rear and bottom panels being equal, a retaining lip emanating from the uppermost edge of said rear panel and angled toward said bottom panel, an attachment strip emanating from the front edge of said bottom panel and extending upwardly therefrom, an extension plate emanating from the central portion of the front edge of said bottom panel and extending substantially forwardly therefrom, and an elongated rod of circular cross section emanating from said extension plate, the axis of said rod being parallel to the front edge of said bottom panel and the length of said rod being substantially equal to the lengths of said rear and bottom panels, b. a bracket member of integral monolithic construction derived from an extruded structure and having a generally L-shaped configuration comprised of a flat vertical panel having straight parallel uppermost and lowermost extremities, a flat horizontal panel emanating from the lowermost extremity of said vertical panel, extending perpendicularly from said vertical panel and terminating in a forward edge, said vertical and horizontal panels being of equal lengths between parallel side edges, a pair of spaced apart coaxially disposed circular cylindrical bushings emanating from said forward edge, and having facing and outer extremities disposed in planes perpendicular to said forward edge, at least one of said bushings having a slot positioned at an elevation above said horizontal panel aligned coextensively with the axis of said bushings and having a width sufficient to permit edgewide passage of said extension plate, and abutment tabs emanating from said bushings at sites below said horizontal panel and extending downwardly therefrom, and c. cylindrical sleeve bearings immoveably held within said bushings, said harness member being positioned with respect to said bracket member in a manner such that said rod is insertively and rotatably engaged by said sleeve bearings, and said extension plate is positioned between said bushings in sliding abutment therewith.

2. The bracket assembly of claim 1 wherein the rear panel of said harness member possesses resilient characteristics.

3. The bracket assembly of claim 1 wherein the outer extremities of said bushings are coplanar with the side edges of said vertical and horizontal panels of said bracket member.

4. The bracket assembly of claim 1 wherein the width of the rear panel of said harness member is substantially equal to the width of the vertical panel of said bracket member, and the width of the bottom panel of said harness member is substantially equal to the width of the horizontal panel of said bracket member.

* * * * *